US012398570B2

(12) United States Patent
Li et al.

(10) Patent No.: US 12,398,570 B2
(45) Date of Patent: Aug. 26, 2025

(54) FLOORBOARD WITH COUPLING STRUCTURE

(71) Applicant: JIANGSU BBL HOME TECHNOLOGY CO., LTD., Changzhou (CN)

(72) Inventors: Yanhui Li, Changzhou (CN); Junxiang Dong, Changzhou (CN); Hongkai Xu, Changzhou (CN)

(73) Assignee: JIANGSU BBL HOME TECHNOLOGY CO., LTD., ChangZhou (CN)

( * ) Notice: Subject to any disclaimer, the term of this patent is extended or adjusted under 35 U.S.C. 154(b) by 0 days.

(21) Appl. No.: 18/985,386

(22) Filed: Dec. 18, 2024

(65) Prior Publication Data

US 2025/0116121 A1 Apr. 10, 2025

Related U.S. Application Data

(63) Continuation of application No. PCT/CN2024/129966, filed on Nov. 5, 2024.

(30) Foreign Application Priority Data

Oct. 30, 2024 (CN) ..... 202411527671.3

(51) Int. Cl.
*E04F 15/02* (2006.01)

(52) U.S. Cl.
CPC ..... *E04F 15/02038* (2013.01); *E04F 2015/02116* (2013.01); *E04F 2201/0138* (2013.01); *E04F 2201/0146* (2013.01); *E04F 2201/0161* (2013.01); *E04F 2201/023* (2013.01); *E04F 2201/043* (2013.01)

(58) Field of Classification Search
CPC ..... E04F 15/02038; E04F 2201/023; E04F 2201/043; E04F 2201/0161; E04F 2201/0138; E04F 2201/0146; E04F 2015/02116; E04F 15/02005
See application file for complete search history.

(56) References Cited

U.S. PATENT DOCUMENTS

| | | | | |
|---|---|---|---|---|
| 6,536,178 | B1 * | 3/2003 | Pålsson et al. | B44C 3/123 52/392 |
| 11,225,800 | B2 * | 1/2022 | De Rick | E04F 15/105 |
| 11,591,806 | B2 * | 2/2023 | Fahle | E04F 15/02038 |
| 2005/0204662 | A1 * | 9/2005 | Showers | E04F 15/10 52/263 |

(Continued)

*Primary Examiner* — Brent W Herring

(57) ABSTRACT

A floorboard includes a board body, a first coupling structure with a tenon and a second coupling structure with a mortise. The tenon includes a first side portion and a second side portion. A second side portion includes a first connecting surface and a second connecting surface. The mortise includes a first recess and a second recess. The second recess includes a third connecting surface and a fourth connecting surface. When two floorboards are connected, the first coupling structure of one of the two floors is matched with the second coupling structure of the other of the two floors, and the first connecting surface of one of the two floorboards is matched with the third connecting surface of the other of the two floorboards, so as to lock the connection of the two floorboards.

9 Claims, 18 Drawing Sheets

(56) References Cited

U.S. PATENT DOCUMENTS

| | | | | |
|---|---|---|---|---|
| 2007/0022689 | A1* | 2/2007 | Thrush | E04F 13/18 52/392 |
| 2011/0131909 | A1* | 6/2011 | Hannig | E04F 15/02 52/309.1 |
| 2011/0247285 | A1* | 10/2011 | Wybo | B29C 66/12841 264/211.13 |
| 2012/0096801 | A1* | 4/2012 | Cappelle | E04F 15/02038 52/592.1 |
| 2021/0254349 | A1* | 8/2021 | Schäfers | E04F 15/102 |
| 2023/0090055 | A1* | 3/2023 | Bladh | E04F 15/02038 52/588.1 |
| 2023/0304299 | A1* | 9/2023 | Boucké | E04F 15/10 |
| 2024/0229452 | A1* | 7/2024 | Quist | E04B 1/6116 |

* cited by examiner

FLOORBOARD WITH COUPLING STRUCTURE

CROSS-REFERENCE TO RELATED APPLICATIONS

This application is a continuation of International Patent Application No. PCT/CN2024/129966, filed on Nov. 5, 2024, which claims the benefit of priority from Chinese Patent Application No. 202411527671.3, filed on Oct. 30, 2024. The content of the aforementioned application, including any intervening amendments thereto, is incorporated herein by reference in its entirety.

TECHNICAL FIELD

This application relates to flooring, and more particularly to a floorboard with a coupling structure.

BACKGROUND

Flooring has an important functional and aesthetic value as an indoor and outdoor covering material. The spliced flooring is formed by multiple floorboards connected by a lock catch or a mortise and tenon joint structure. The spliced flooring is characterized by easy assembly, disassembly and replacement, and absence of glue. During the manufacture of the existing spliced floorboards, the mortise is usually processed to have a flat-straight edge, but such mortise fails to ensure a stable and firm connection. In the practical use, the connection will become loosened, and the gap will become wider and wider, thus affecting the service life of the flooring.

SUMMARY

In view of the deficiencies in the prior art, this application provides a floorboard with improved connection strength and stability.

Technical solutions of this application are described as follows

This application provides a floorboard, comprising:

a board body;

a first coupling structure; and a second coupling structure;

wherein the first coupling structure and the second coupling structure are provided on opposite sides of the board body, respectively; the first coupling structure comprises a first tenon; the second coupling structure is provided with a first mortise; and the first mortise is configured to accommodate at least a part of the first tenon for floorboard connection;

the first tenon comprises a first side portion and a second side portion; the first side portion is configured to at least partially slope downwardly towards the second coupling structure; the second side portion is configured to protrude in a direction away from the second coupling structure; the second side portion comprises a first connecting surface and a second connecting surface; the first connecting surface is configured to at least partially slope downwardly from a bottom end of the first side portion towards the direction away from the second coupling structure; and the second connecting surface is configured to at least partially slope downwardly from a bottom end of the first connecting surface towards the second coupling structure;

the first mortise comprises a first recess and a second recess; the first recess is located above the second recess; the first recess and the second recess are both recessed towards the first coupling structure; the second recess comprises a third connecting surface and a fourth connecting surface; the third connecting surface is configured to at least partially slope downwardly from a bottom end of the first recess towards the first coupling structure; the fourth connecting surface is configured to at least partially slope downwardly from a bottom end of the third connecting surface towards a direction away from the first coupling structure; and in response to a case of connecting two floorboards, the first coupling structure of one of the two floorboards is matched with the second coupling structure of the other of the two floorboards, and the first connecting surface of one of the two floorboards is matched with the third connecting surface of the other of the two floorboards, so as to lock the two floorboards in a connection state.

In an embodiment, the first tenon further comprises a first bottom structure and a third side portion; the first bottom structure is configured to extend from an end of the second connecting surface away from the first connecting surface towards the second coupling structure; and the third side portion is configured to at least partially slope downwardly towards the direction away from the second coupling structure, and is connected to an end of the first bottom structure away from the second side portion.

In an embodiment, the first mortise further comprises a first base surface and a second base surface; the first base surface is configured to extend from a bottom end of the fourth connecting surface towards the direction away from the first coupling structure; the second base surface is configured to at least partially slope downwardly towards the first coupling structure, and is connected to an end of the first base surface away from the fourth connecting surface; and in response to a case that two floorboards are connected, the first base surface of one of the two floorboards abuts against the first bottom structure of the other of the two floorboards, and the second base surface of one of the two floorboards abuts against the third side portion of the other of the two floorboards.

In an embodiment, the first bottom structure comprises a first bottom portion and a second bottom portion; an end of the first bottom portion is connected to the end of the second connecting surface away from the first connecting surface; and the first bottom portion is provided horizontally; and the second bottom portion is convex downwardly relative to the first bottom portion; and the first base surface is matched with the first bottom structure; and an area of the first base surface corresponding to the second bottom portion is downwardly recessed to fit the second bottom portion; or the second bottom portion is upwardly recessed relative to the first bottom portion and the area of the first base surface corresponding to the second bottom portion is convex upwardly to fit the second bottom portion.

In an embodiment, the first coupling structure further comprises a second tenon; the second coupling structure is further provided with a second mortise; the second tenon is provided on an inner side of the first tenon; the second mortise is provided on an outer side of the first mortise; and the second mortise is configured to accommodate at least a part of the second tenon.

In an embodiment, the second tenon comprises a fourth side portion, a second bottom structure and a fifth side portion; the fourth side portion is configured to at least partially extend downwardly, and is connected with a first end of the second bottom structure; the second bottom structure is configured to extend from a bottom end of the fourth side portion towards a direction away from the first tenon; and the fifth side portion is configured to at least partially extend downwardly, and is connected with a second end of the second bottom structure.

In an embodiment, the fourth side portion comprises a first straight section, a first inclined section, a second straight section and a second inclined section; the first straight section is configured to extend downwardly; the first inclined section is configured to at least partially slope downwardly from an end of the first straight section towards the first tenon; the second straight section is configured to extend downwardly from an end of the first inclined section away from the first straight section; and the second inclined section is configured to at least partially slope downwardly from an end of the second straight section away from the first inclined section towards a direction away from the first tenon, and is connected to the first end of the second bottom structure.

In an embodiment, the fifth side portion comprises a third inclined section, a fourth inclined section and a fifth inclined section connected in sequence; the third inclined section is configured to at least partially slope downwardly towards the first tenon, and is connected to the second end of the second bottom structure; the fourth inclined section is configured to at least partially slope downwardly towards the direction away from the first tenon, and is connected to an end of the third inclined section away from the second bottom structure; and the fifth inclined section is configured to at least partially slope downwardly towards the first tenon, and is connected to an end of the fourth inclined section away from the third inclined section.

In an embodiment, the second mortise comprises a first plane, a second plane, a third plane, a fourth plane, a fifth plane, a sixth plane, a seventh plane and an eighth plane connected in sequence;

the first plane is configured to extend downwardly; the second plane is configured to at least partially slope downwardly from an end of the first plane towards the first mortise; the third plane is configured to extend downwardly from an end of the second plane away from the first plane; the fourth plane is configured to at least partially slope downwardly from an end of the third plane away from the second plane towards a direction away from the first mortise; the fifth plane is configured to extend from an end of the fourth plane away from the third plane towards the direction away from the first mortise; the sixth plane is configured to slope downwardly towards the first mortise, and is connected to an end of the fifth plane away from the fourth plane; the seventh plane is configured to at least partially slope downwardly towards the direction away from the first mortise, and is connected to an end of the sixth plane away from the fifth plane; and the eighth plane is configured to at least partially slope downwardly towards the first mortise, and is connected to an end of the seventh plane away from the sixth plane; and in response to a case that two floorboards are connected, the first plane of one of the two floorboards abuts against the first straight section of the other of the two floorboards, the second plane of one of the two floorboards abuts against the first inclined section of the other of the two floorboards, the third plane of one of the two floorboards abuts against the second straight section of the other of the two floorboards, the fourth plane of one of the two floorboards abuts against the second inclined section of the other of the two floorboards, the fifth plane of one of the two floorboards abuts against the second bottom structure of the other of the two floorboards, the sixth plane of one of the two floorboards abuts against the third inclined section of the other of the two floorboards, the seventh plane of one of the two floorboards abuts against the fourth inclined section of the other of the two floorboards, and the eighth plane of one of the two floorboards abuts against the fifth inclined section of the other of the two floorboards.

In an embodiment, the second bottom structure comprises a first bottom portion and a second bottom portion; a first end of the first bottom portion is connected to an end of the second inclined section away from the second straight section, and a second end of the first bottom portion is connected to a first end of the second bottom portion; a second end of the second bottom portion is connected to an end of the third inclined section away from the fourth inclined section; and the first bottom portion is provided horizontally; and the second bottom portion is recessed upwardly relative to the first bottom portion; the fifth plane is matched with the second bottom structure; and an area of the fifth plane corresponding to the second bottom portion is convex upwardly to fit the second bottom portion; or the second bottom portion is convex downwardly relative to the first bottom portion; and the area of the fifth plane corresponding to the second bottom portion is recessed downwardly to fit the second bottom portion.

In an embodiment, a third mortise is provided between the first tenon and the second tenon; a third tenon is provided between the first mortise and the second mortise; and the third tenon is configured to fit the third mortise; and a sixth inclined section is provided between the third side portion and the fourth side portion; the sixth inclined section is configured to at least partially slope downwardly from an end of the third side portion away from the first bottom structure towards the direction away from the first tenon, and is connected to an end of the fourth side portion away from the second bottom structure; and the third side portion, the sixth inclined section and the fourth side portion are configured to together enclose the third mortise.

In an embodiment, the second coupling structure further comprises a ninth plane; the ninth plane is configured to slope downwardly from an end of the second base surface away from the first base surface towards the direction away from the first mortise, and is connected to an end of the first plane away from the second plane;

the second base surface, the ninth plane, the first plane, the second plane, the third plane and the fourth plane are configured to together enclose the third tenon; and in response to a case that two floorboards are connected, the second base surface of one of the two floorboards abuts against the third side portion of the other of the two floorboards, the ninth plane of one of the two floorboards abuts against the sixth inclined section of the other of the two floorboards, the first plane of one of the two floorboards abuts against the first straight section of the other of the two floorboards, the second plane of one of the two floorboards abuts against the first inclined section of the other of the two floorboards, the third plane of one of the two floorboards abuts against the second straight section of the other of the two floorboards, and the fourth plane of one of the two floorboards abuts against the second inclined section of the other of the two floorboards.

Compared with the prior art, this application has the following technical effects.

A floorboard provided in this application includes a board body, and a first coupling structure and a second coupling structure provided on opposite sides of the board body, respectively. A first tenon of the first coupling structure includes a first side portion and a second side portion. A first mortise of the second coupling structure includes a first recess and a second recess. When two floorboards are connected, the first side portion of one of the two floorboards is partially inserted into the first recess of the other of the two floorboards, and the second side portion of one of the two floorboards is partially inserted into the second recess of the other of the two floorboards. The first connecting surface of the second side portion and the third connecting surface of the second recess are inclined relative to the board body, so when two floorboards are connected, the first connecting surface of one of the two floorboards abuts against the third connecting surface of the other of the two floorboards to lock the floorboards in the horizontal direction and the vertical direction, thereby enhancing the connection stability and reliability and enhancing the connection strength of the floorboards.

BRIEF DESCRIPTION OF THE DRAWINGS

In order to illustrate technical solutions in embodiments of the present disclosure or the prior art more clearly, the required drawings will be briefly described below. Obviously, presented in the drawings are merely some embodiments of the present disclosure, which are not intended to limit the disclosure. For those skilled in the art, other drawings may also be obtained according to the drawings provided herein without paying creative efforts.

Figure 1:
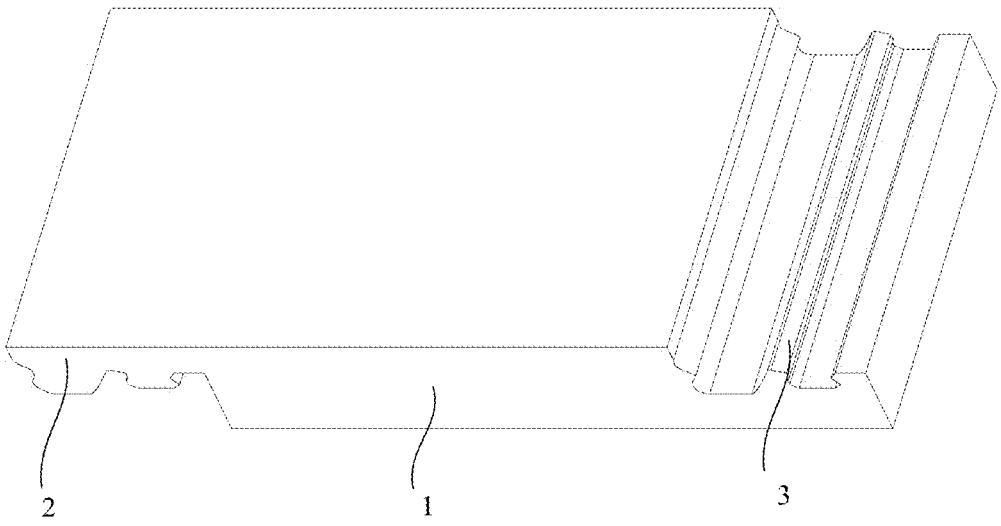
FIG. 1 is a schematic diagram of a floorboard according to Embodiment 1 of the present disclosure.
Figure 2:
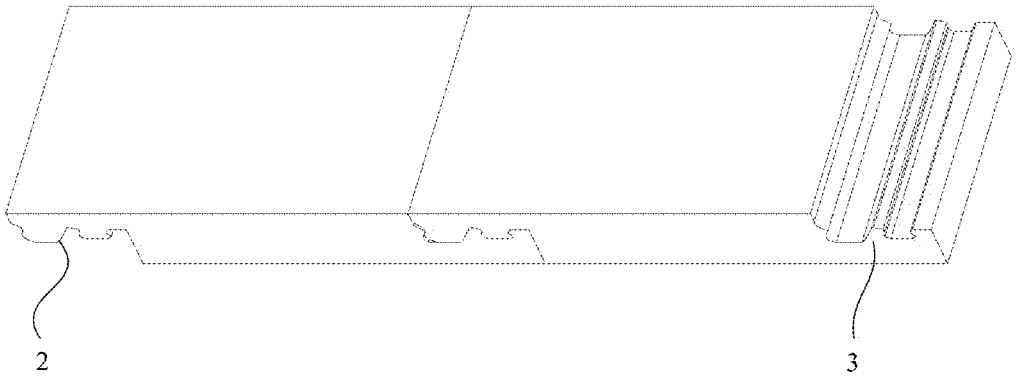
FIG. 2 schematically shows connection of two floorboards according to Embodiment 1 of the present disclosure.
Figure 3:
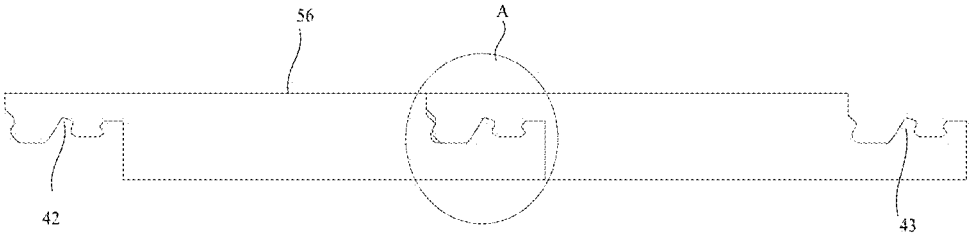
FIG. 3 is a front view of the two floorboards according to Embodiment 1 of the present disclosure in a connection state.
Figure 4:
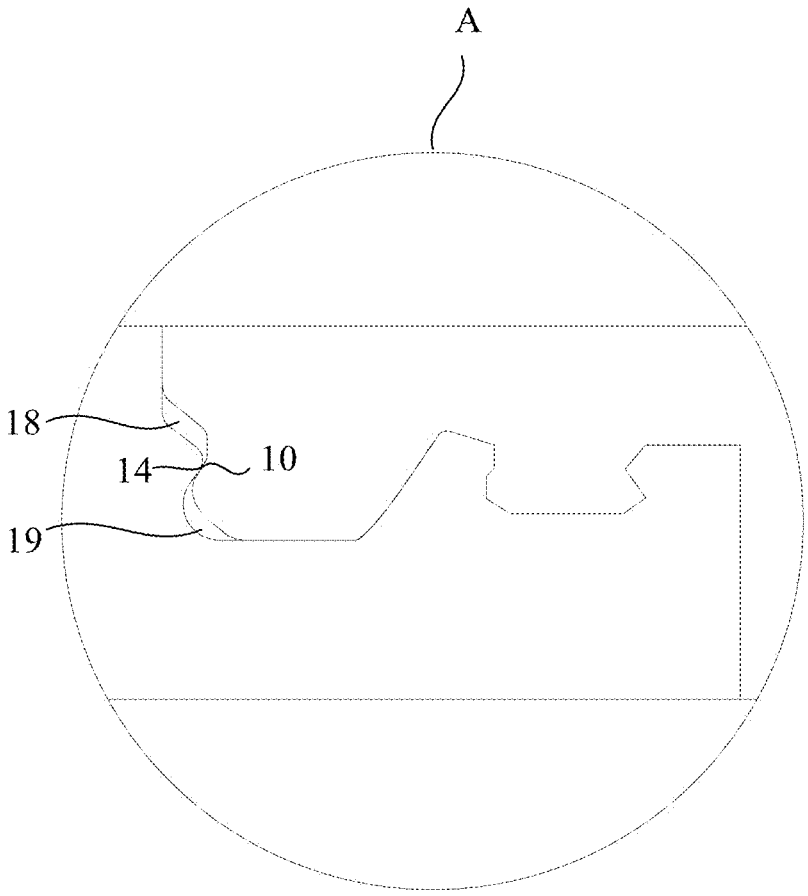
FIG. 4 is an enlarged view of portion "A" in FIG. 3.

1, board body; 2, first coupling structure; 3, second coupling structure; 4, first tenon; 5, first mortise; 6, first side portion; 7, second side portion; 8, first bottom structure; 9, third side portion; 10, first connecting surface; 11, second connecting surface; 12, first recess; 13, second recess; 14, third connecting surface; 15, fourth connecting surface; 16, first base surface; 17, second base surface; 18, first cavity; 19, second cavity; 20, fifth connecting surface; 21, sixth connecting surface; 22, second tenon; 23, second mortise; 24, fourth side portion; 25, second bottom structure; 26, fifth side portion; 27, first straight section; 28, first inclined section; 29, second straight section; 30, second inclined section; 31, third inclined section; 32, fourth inclined section; 33, fifth inclined section; 34, first plane; 35, second plane; 36, third plane; 37, fourth plane; 38, fifth plane; 39, sixth plane; 40, seventh plane; 41, eighth plane; 42, third mortise; 43, third tenon; 44, sixth inclined section; 45, ninth plane; 46, fourth mortise; 47, fourth straight section; 48, fifth straight section; 49, fourth tenon; 50, tenth plane; 51, eleventh plane; 52, first bottom portion; 53, second bottom portion; 54, third bottom portion; 55, fourth bottom portion; and 56, top surface.

The present disclosure will be further described in detail below in conjunction with the accompanying drawings and embodiments to make the objects, features and advantages of the present disclosure better understood.

DETAILED DESCRIPTION OF EMBODIMENTS

The technical solutions of the disclosure will be clearly and completely described in detail below in combination with the drawings in the embodiments. Obviously, described below are merely some embodiments of the disclosure, which are not intended to limit the disclosure. For those skilled in the art, other embodiments obtained based on these embodiments without paying creative efforts should fall within the scope of the disclosure defined by the appended claims.

As used herein, it should be noted that the orientation or positional relationship indicated by the terms "up", "down", "left", "right", "front", and "back", is merely used to describe the relative orientation or positional relationship or movement between individual components in a particular attitude (e.g., in the accompanying drawings), and when the particular attitude is changed, the orientation indication changes accordingly.

In addition, the terms "first", "second" and the like are merely descriptive, and cannot be understood as indicating or implying relative importance, or implying the number of indicated technical features. The terms "first" and "second" indicate at least one of such feature. As used herein, the term "and/or" refers to any possible combinations of one or more of the items listed, and includes those combinations. For example, A and/or B includes A, a combination of A and B, and B. Furthermore, the technical solutions of various embodiments may be combined with each other in the case of no contradiction.

Embodiment 1

Referring to FIGS. 1-9, a floorboard includes a board body 1, a first coupling structure 2 and a second coupling structure 3. The first coupling structure 2 and the second coupling structure 3 are disposed on opposite sides of the board body 1, respectively. The first coupling structure 2 includes a first tenon 4, and the second coupling structure 3 is provided with a first mortise 5. The first mortise 5 is used to accommodate at least a part of the first tenon 4 for floorboard connection.

The first tenon 4 includes a first side portion 6, a second side portion 7, a first bottom structure 8, and a third side portion 9. The first side portion 6 at least partially slopes downwardly towards a direction close to the second coupling structure 3. The second side portion 7 protrudes in a direction away from the second coupling structure 3. The second side portion 7 includes a first connecting surface 10 and a second connecting surface 11. The first connecting surface 10 at least partially slopes downwardly from the bottom end of the first side portion 6 towards the direction away from the second coupling structure 3. The second connecting surface 11 at least partially slopes downwardly from the bottom end of the first connecting surface 10 in a direction close to the second coupling structure 3. The first bottom structure 8 is configured to extend from the end of the second connecting surface 11 away from the first connecting surface 10 towards a direction close to the second coupling structure 3. The third side portion 9 at least partially slopes downwardly towards the direction away from the second coupling structure 3 and is connected to an end of the first bottom structure 8 away from the second side portion 7.

The first mortise 5 includes a first recess 12 and a second recess 13. The first recess 12 is disposed above the second recess 13. The first recess 12 and the second recess 13 are both recessed towards the direction close to the first coupling structure 2. The second recess 13 includes a third connecting surface 14 and a fourth connecting surface 15, and the first mortise 5 further includes a first base surface 16 and a second base surface 17. The third connecting surface 14 at least partially slopes downwardly from the bottom end of the first recess 12 towards the direction close to the first coupling structure 2. The fourth connecting surface 15 at least partially slopes downwardly from the bottom end of the third connecting surface 14 towards a direction away from the first coupling structure 2. The first base surface 16 is configured to extend from a bottom end of the fourth connecting surface 15 towards the direction away from the first coupling structure 2. The second base surface 17 is configured to at least partially slope downwardly towards a direction close to the first coupling structure 2 and is connected to the end of the first base surface 16 away from the fourth connecting surface 15.

In this embodiment, when the floorboards are in the connection state, the first side portion 6 and the first recess 12 enclose a first cavity 18. The first connecting surface 10 and the third connecting surface 14 abuts to each other to lock the floorboards in both the horizontal direction and the vertical direction in the connection state. The first connecting surface 10, the second connecting surface 11, the third connecting surface 14 and the fourth connecting surface 15 are configured to enclose a second cavity 19. The first base surface 16 abuts against the first bottom structure 8 to lock the floorboards in the vertical direction for coupling the floorboards. The second base surface 17 abuts against the third side portion 9 to further provide force components in the horizontal and vertical directions for the floorboard connection to improve the connection stability.

Since there is dimensional error when the floorboard is grooved, the first cavity 18 and the second cavity 19 can reduce the phenomenon of uneven upper parts when two floorboards are joined due to dimensional errors caused by grooving.

The first bottom structure 8 is horizontally provided and is parallel to the width direction of the board body 1.

Specifically, the horizontal direction is parallel to the width direction of the board body 1, and the vertical direction is parallel to the thickness direction of the board body 1.

Specifically, the first connecting surface 10 and the second connecting surface 11 are transitionally connected by a circular arc. The third connecting surface 14 and the fourth connecting surface 15 are transitionally connected by a circular arc. The curved surface is designed for reducing the friction between the first tenon 4 and the first mortise 5 when spliced together, so as to make the splicing smoother and avoid jamming.

In this embodiment, the first coupling structure 2 further includes a fifth connecting surface 20. The second coupling structure 3 further includes a sixth connecting surface 21. The fifth connecting surface 20 is disposed vertically or tilted above the first side portion 6 and connected to the top surface of the floorboard. The sixth connecting surface 21 is disposed vertically or tilted above the first recess 12 and connected to the top surface of the floorboard. The fifth connecting surface 20 and the sixth connecting surface 21 are inclined at equal angles with respect to the thickness direction of the board body 1 to achieve seamless fitting of the fifth connecting surface 20 and the sixth connecting surface 21. Further, there is a certain distance between the first cavity 18 and the top surface 56 of the floorboard. In response to a case of connecting two floorboards, the first coupling structure 2 of one of the two floorboards can be tightly affixed to the upper portion of the side surface of the second coupling structure 3 of the other of the two floorboards. The fifth connecting surface 20 of the first coupling structure 2 and the sixth connecting surface 21 of the second coupling structure 3 are tightly affixed to each other, which not only meets the demand for aesthetics but also avoids debris from entering the first cavity 18.

Figure 6:
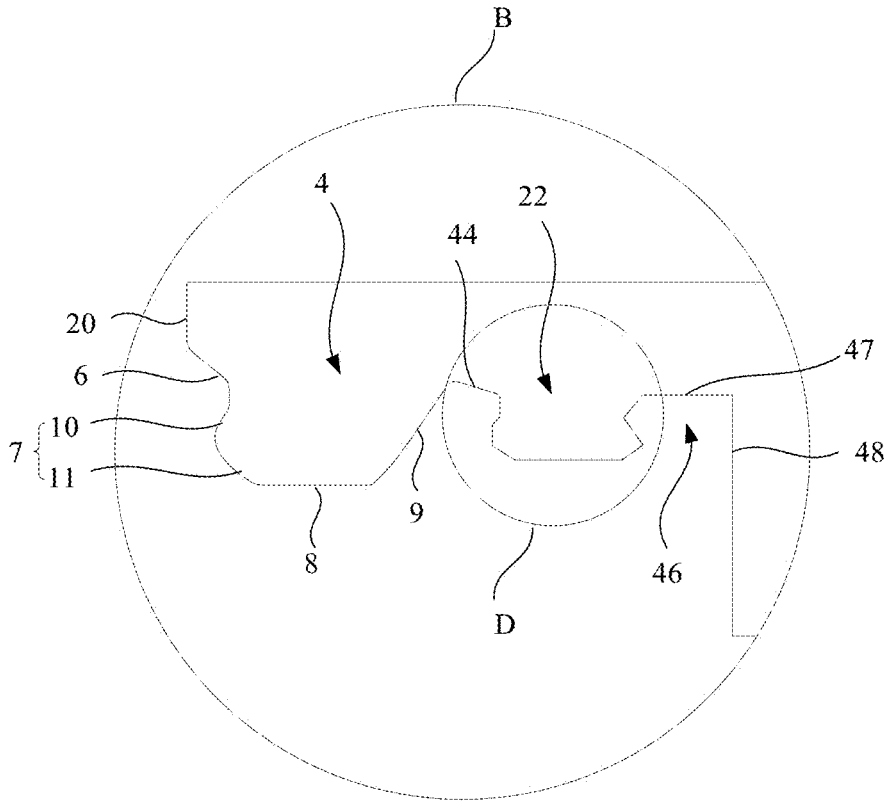
FIG. 6 is an enlarged view of portion "B" in FIG. 5.
Figure 8:
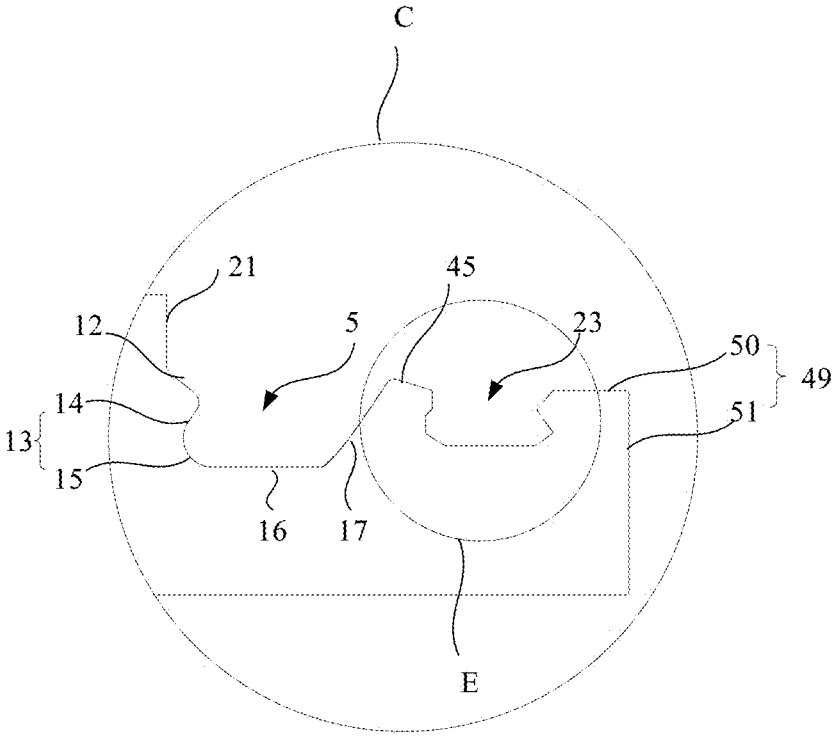
FIG. 8 is an enlarged view of portion "C" in FIG. 5.

Referring to FIGS. 6 and 8, the first coupling structure 2 further includes a second tenon 22. The second coupling structure 3 is further provided with a second mortise 23. The second tenon 22 is provided on the inner side of the first tenon 4. The second mortise 23 is provided on the outer side of the first mortise 5. The second mortise 23 is used to accommodate at least a part of the second tenon 22.

Figure 7:
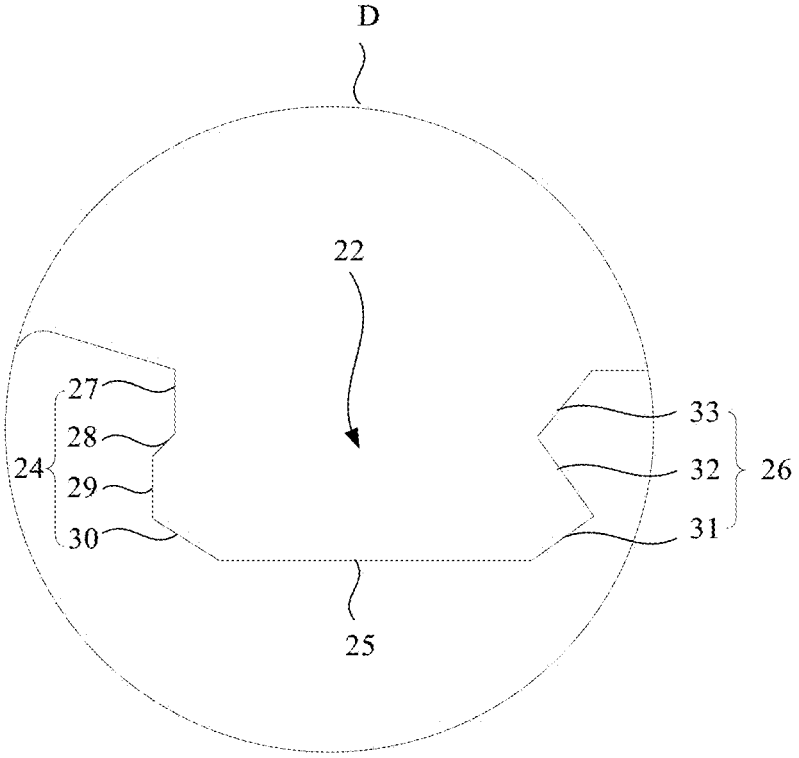
FIG. 7 is an enlarged view of portion "D" in FIG. 6.

Referring to FIGS. 6 and 7, the second tenon 22 includes a fourth side portion 24, a second bottom structure 25, and a fifth side portion 26. The fourth side portion 24 is configured to at least partially extend downwardly and is connected to one end of the second bottom structure 25. The second bottom structure 25 is configured to extend from the bottom end of the fourth side portion 24 towards a direction away from the first tenon 4. The fifth side portion 26 is configured to at least partially extend downwardly and is connected to the other end of the second bottom structure 25.

Specifically, the fourth side portion 24 includes a first straight section 27, a first inclined section 28, a second straight section 29 and a second inclined section 30. The first straight section 27 is configured to extend downwardly. The first inclined section 28 is configured to at least partially slope downwardly from one end of the first straight section 27 towards the direction close to the first tenon 4. The second straight section 29 is configured to extend downwardly from one end of the first inclined section 28 away from the first straight section 27. The second inclined section 30 is configured to at least partially slope downwardly from the end of the second straight section 29 away from the first inclined section 28 towards a direction away from the first tenon 4, and is connected to an end of a second bottom structure 25. The second bottom structure 25 is configured to extend from the end of the second inclined section 30 away from the second straight section 29 towards the direction away from the first tenon 4.

The fifth side portion 26 includes a third inclined section 31, a fourth inclined section 32 and a fifth inclined section 33 which are connected to each other. The third inclined section 31 at least partially slopes downwardly towards a direction close to the first tenon 4 and is connected to the end of the second bottom structure 25 away from the second inclined section 30. The fourth inclined section 32 at least partially slopes downwardly towards the direction away from the first tenon 4 and is connected to the end of the third inclined section 31 away from the second bottom structure 25. The fifth inclined section 33 at least partially slope downwardly towards a direction close to the first tenon 4 and is connected to the end of the fourth inclined section 32 away from the third inclined section 31.

Specifically, the second bottom structure 25 includes a third straight section which is substantially flat.

Figure 9:
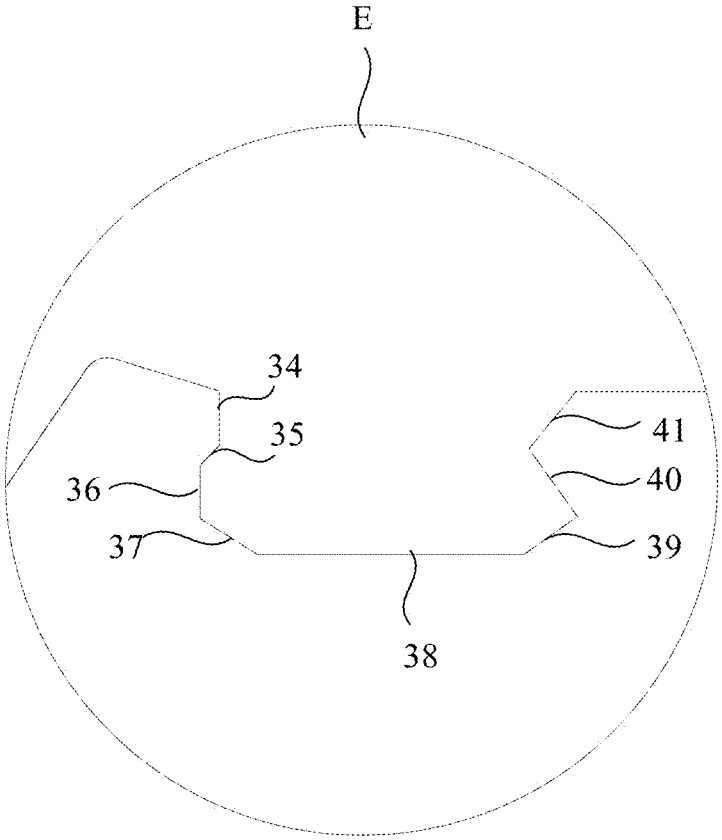
FIG. 9 is an enlarged view of portion "E" in FIG. 8.

Referring to FIGS. 8 and 9, the second mortise 23 includes a first plane 34, a second plane 35, a third plane 36, a fourth plane 37, a fifth plane 38, a sixth plane 39, a seventh plane 40, and an eighth plane 41 connected in sequence. The first plane 34 is configured to extend downwardly. The second plane 35 at least partially slopes downwardly from the end of the first plane 34 towards the direction close to the first mortise 5. The third plane 36 is configured to extend downwardly from an end of the second plane 35 away from the first plane 34. The fourth plane 37 is configured to at least partially slope downwardly from an end of the third plane 36 away from the second plane 35 towards the direction away from the first mortise 5. The fifth plane 38 is configured to extend downwardly from an end of the fourth plane 37 away from the third plane 36 towards the direction away from the first mortise 5. The sixth plane 39 slopes downwardly towards the direction close to the first mortise 5, and is connected to the end of the fifth plane 38 away from the fourth plane 37. The seventh plane 40 at least partially downwardly slopes towards the direction away from the first mortise 5, and is connected to the end of the sixth plane 39 away from the fifth plane 38. The eighth plane 41 at least partially slopes downwardly in the direction close to the first mortise 5, and is connected to the end of the seventh plane 40 away from the sixth plane 39.

In response to a case that two floorboards are connected, the first plane 34 of one of the two floorboards abuts against the first straight section 27 of the other of the two floorboards; the second plane 35 of one of the two floorboards abuts against the first inclined section 28 of the other of the two floorboards; the third plane 36 of one of the two floorboards abuts against the second straight section 29 of the other of the two floorboards; the fourth plane 37 of one of the two floorboards abuts against the second inclined section 30 of the other of the two floorboards; the fifth plane 38 of one of the two floorboards abuts against the second bottom structure 25 of the other of the two floorboards; the sixth plane 39 of one of the two floorboards abuts against the third inclined section 31 of the other of the two floorboards; the seventh plane 40 of one of the two floorboards abuts against the fourth inclined section 32 of the other of the two floorboards; and the eighth plane 41 of one of the two floorboards abuts against the fifth inclined section 33 of the other of the two floorboards, further improving the connection stability of the two floorboards.

Figure 5:
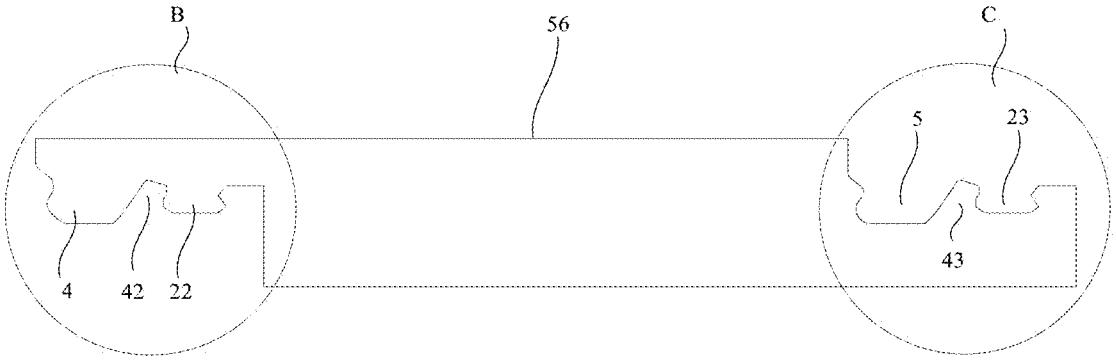
FIG. 5 is a front view of the floorboard according to Embodiment 1 of the present disclosure.

As shown in FIG. 5, when the floorboards are installed, the first mortise 5 and the second mortise 23 faces upwards, and the first tenon 4 and the second tenon 22 faces downwards.

In this embodiment, the vertical distance between the first bottom structure 8 and the top surface 56 of the floorboard is greater than the vertical distance between the second bottom structure 25 and the top surface 56 of the floorboard, which facilitates the insertion of the first tenon 4 into the first mortise 5 during installation.

Referring to FIGS. 3 and 6-9, a third mortise 42 is provided between the first tenon 4 and the second tenon 22. A third tenon 43 is provided between the first mortise 5 and the second mortise 23. The third tenon 43 is used to fit the third mortise 42. A sixth inclined section 44 is provided between the third side portion 9 and the fourth side portion 24. The sixth inclined section 44 at least partially slopes downwardly from an end of the third side portion 9 away from the first bottom structure 8 towards the direction away from the first tenon 4, and is connected to an end of the fourth side portion 24 away from the second bottom structure 25. The third side portion 9, the sixth inclined section 44, and the fourth side portion 24 are configured to together enclose the third mortise 42.

Specifically, the second coupling structure 3 further includes a ninth plane 45. The ninth plane 45 slopes downwardly from the end of the second base surface 17 away from the first base surface 16 towards the direction away from the first mortise 5, and is connected to the end of the first plane 34 away from the second plane 35. The second base surface 17, the ninth plane 45, the first plane 34, the second plane 35, the third plane 36 and the fourth plane 37 enclose the third tenon 43. When the two floorboards are connected, the second base surface 17 of one of the two floorboards abuts against the third side portion 9 of the other of the two floorboards; the ninth plane 45 of one of the two floorboards abuts against the sixth inclined section 44 of the other of the two floorboards; the first plane 34 of one of the two floorboards abuts against the first straight section 27 of the other of the two floorboards; the second plane 35 of one of the two floorboards abuts against the first inclined section 28 of the other of the two floorboards; the third plane 36 of one of the two floorboards abuts against the second straight section 29 of the other of the two floorboards; and the fourth plane 37 of one of the two floorboards abuts against the second inclined section 30 of the other of the two floorboards.

Further, the first coupling structure 2 is further provided with a fourth mortise 46. The first coupling structure 2 further includes a fourth straight section 47 and a fifth straight section 48. The fourth straight section 47 is configured to extend from the end of the fifth inclined section 33 away from the fourth inclined section 32 towards the direction away from the first tenon 4. The fifth straight section 48 is configured to extend downwardly from the end of the fifth plane 38 away from the fifth inclined section 33. The third inclined section 31, the fourth inclined section 32, the fifth inclined section 33, the fourth straight section 47, and the fifth straight section 48 enclose the fourth mortise 46.

In this embodiment, the fourth straight section 47 is configured to extend horizontally. The fifth straight section 48 is configured to extend vertically. In other embodiments, the fifth straight section 48 slopes with respect to the board body 1, and the fifth straight section 48 slopes at an angle of 30-60 degrees with respect to the thickness direction of the board body 1, and preferably at the angle of 40-50 degrees.

Accordingly, the second coupling structure 3 further includes a fourth tenon 49. The second coupling structure 3 further includes a tenth plane 50 and an eleventh plane 51. The tenth plane 50 is configured to extend from an end of the eighth plane 41 away from the seventh plane 40 towards a direction away from the first mortise 5. The eleventh plane 51 is configured to extend downwardly from an end of the tenth plane 50 away from the eighth plane 41. The sixth plane 39, the seventh plane 40, the eighth plane 41, the tenth plane 50 and the eleventh plane 51 are configured to enclose the fourth tenon 49. The fourth tenon 49 of one of the two floorboards is inserted into the fourth mortise 46 of the other of the two floorboards. The sixth plane 39 of one of the two floorboards abuts against the third inclined section 31 of the other of the two floorboards. The seventh plane 40 of one of the two floorboards abuts against the fourth inclined section 32 of the other of the two floorboards. The eighth plane 41 of one of the two floorboards abuts against the fifth inclined section 33 of the other of the two floorboards. The tenth plane 50 of one of the two floorboards abuts against the fourth straight section 47 of the other of the two floorboards. The eleventh plane 51 of one of the two floorboards abuts against the fifth straight section 48 of the other of the two floorboards.

In this embodiment, the tenth plane 50 is configured to extend horizontally. The eleventh plane 51 is configured to extend vertically. In other embodiments, the eleventh plane 51 slopes with respect to the board body 1. The eleventh plane 51 and the fifth straight section 48 have the same inclined angle. The inclined angle of the eleventh plane 51 with respect to the thickness direction of the board body 1 is 30-60 degrees, preferably 40-50 degrees.

In this disclosure, the first tenon 4 is embedded in the first mortise 5, the second tenon 22 is embedded in the second mortise 23, the third tenon 43 is embedded in the third mortise 42, and the fourth tenon 49 is embedded in the fourth mortise 46. The multiple tenons and mortises are combined to enhance the strength of the floor joints and improve the stability of the floor joints. The multiple tenons and mortises make the force more evenly distributed and reduce the concentration of stress in one place, reducing the risk of deformation and damage to the floor material. The tenons are inserted into the mortises with a plurality of contact surfaces against each other, thereby providing stability for the floor joints when subjected to horizontal or vertical forces. Furthermore, a plurality of contact surfaces share the forces simultaneously, improving the service life and reliability of the first coupling structure 22 and the second coupling structure 33.

The installation process of two floorboards are as follows. The first tenon 4 of one of the two floorboards is first inserted into the first mortise 5 of the other of the two floorboards during installation. A force is applied to the top of the second tenon 22 to press the floor down, the second tenon 22 of one of the two floorboards is inserted into the second mortise 23 of the other of the two floorboards, at the same time, the third tenon 43 of one of the two floorboards is inserted into the third mortise 42 of the other of the two floorboards, and the fourth tenon 49 of one of the two floorboards is inserted into the fourth mortise 46 of the other of the two floorboards. The fifth connecting surface 20 of the first coupling structure 2 of one of the two floorboards is tightly affixed to the sixth connecting surface 21 of the second coupling structure 3 of the other of the two floorboards. The eleventh plane 51 of one of the two floorboards is next to the fifth straight section 48 of the other of the two floorboards.

Embodiment 2

Figure 10:
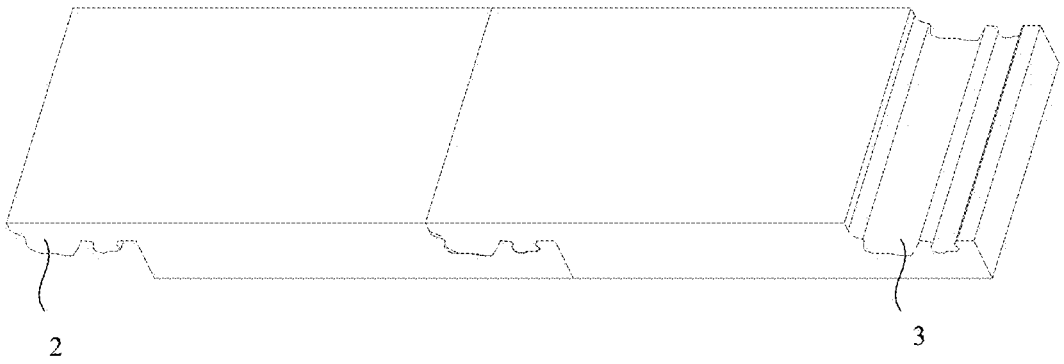
FIG. 10 schematically shows connection of two floorboards according to Embodiment 2 of the present disclosure.
Figure 11:
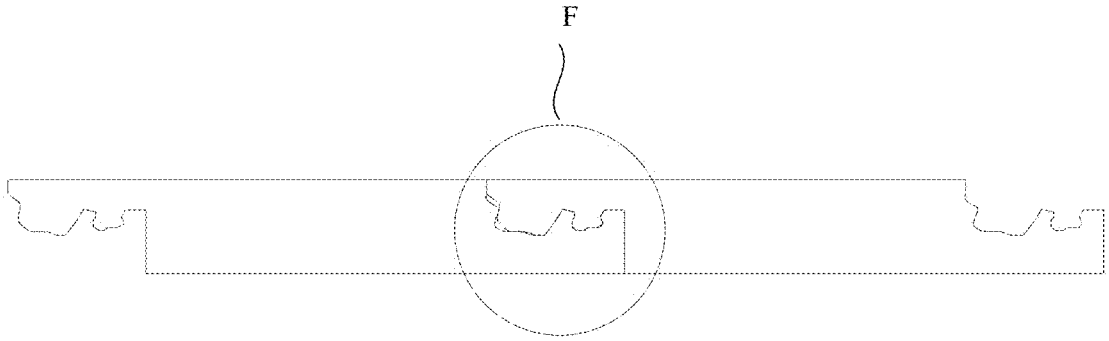
FIG. 11 is a front view of the two floorboards according to Embodiment 2 of the present disclosure in a connection state.
Figure 12:
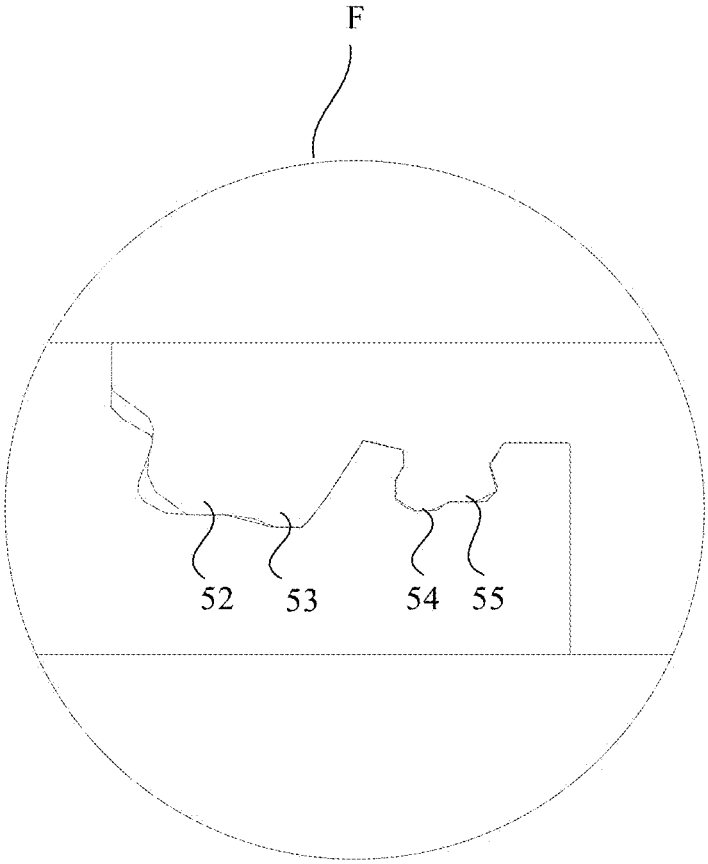
FIG. 12 is an enlarged view of portion "F" in FIG. 11.

Referring to FIGS. 10-12, differences from embodiment 1 are as follows. The first bottom structure 8 includes a first bottom portion 52 and a second bottom portion 53. One end of the first bottom portion 52 is connected to an end of the second connecting surface 11 away from the first connecting surface 10, and the other end of the first bottom portion 52 is connected to an end of the second bottom portion 53. The other end of the second bottom portion 53 is connected to an end of the third side portion 9. The first bottom portion 52 is disposed horizontally. The second bottom portion 53 is convex downwardly with respect to the first bottom portion 52. Correspondingly, the first base surface 16 is provided to match the first bottom structure 8. The area of the first base surface 16 corresponding to the second bottom portion 53 is downwardly recessed to fit the second bottom portion 53. The second bottom structure 25 includes a third bottom portion 54 and a fourth bottom portion 55. One end of the third bottom portion 54 is connected to an end of the second inclined section 30 away from the second straight section 29, and the other end of the third bottom portion 54 is connected to an end of the fourth bottom portion 55. The other end of the fourth bottom portion 55 is connected to the end of the third inclined section 31 away from the fourth inclined section 32. The third bottom portion 54 is provided horizontally. The fourth bottom portion 55 is recessed upwardly with respect to the third bottom portion 54. Correspondingly, the fifth plane 38 of the second mortise 23 is matched with the second bottom structure 25. The area of the fifth plane 38 corresponding to the fourth bottom portion 55 is convex upwardly to fit the fourth bottom portion 55.

In other embodiments, the second bottom portion 53 is convex downwardly with respect to the first bottom portion 52. The fourth bottom portion 55 is convex downwardly with respect to the third bottom portion 54. The position of the fifth plane 38 corresponding to the fourth bottom portion 55 is recessed downwardly.

Embodiment 3

Figure 13:
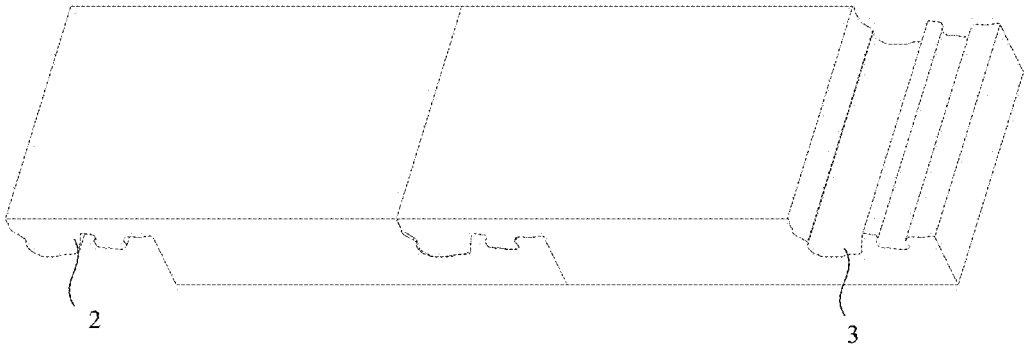
FIG. 13 schematically shows connection of two floorboards according to Embodiment 3 of the present disclosure.
Figure 14:
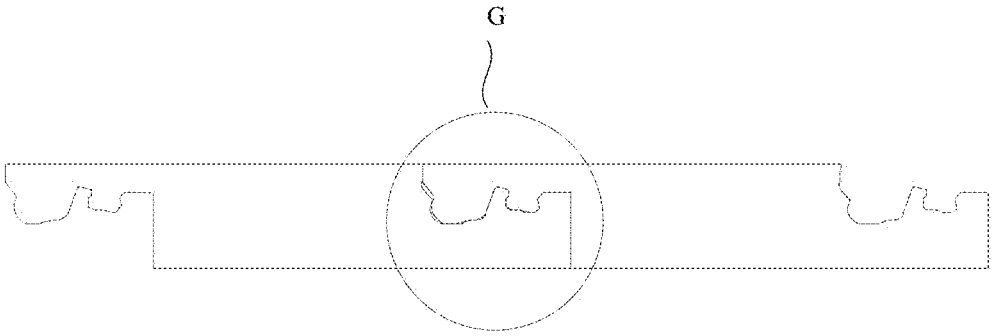
FIG. 14 is a front view of the two floorboards according to Embodiment 3 of the present disclosure in a connection state.
Figure 15:
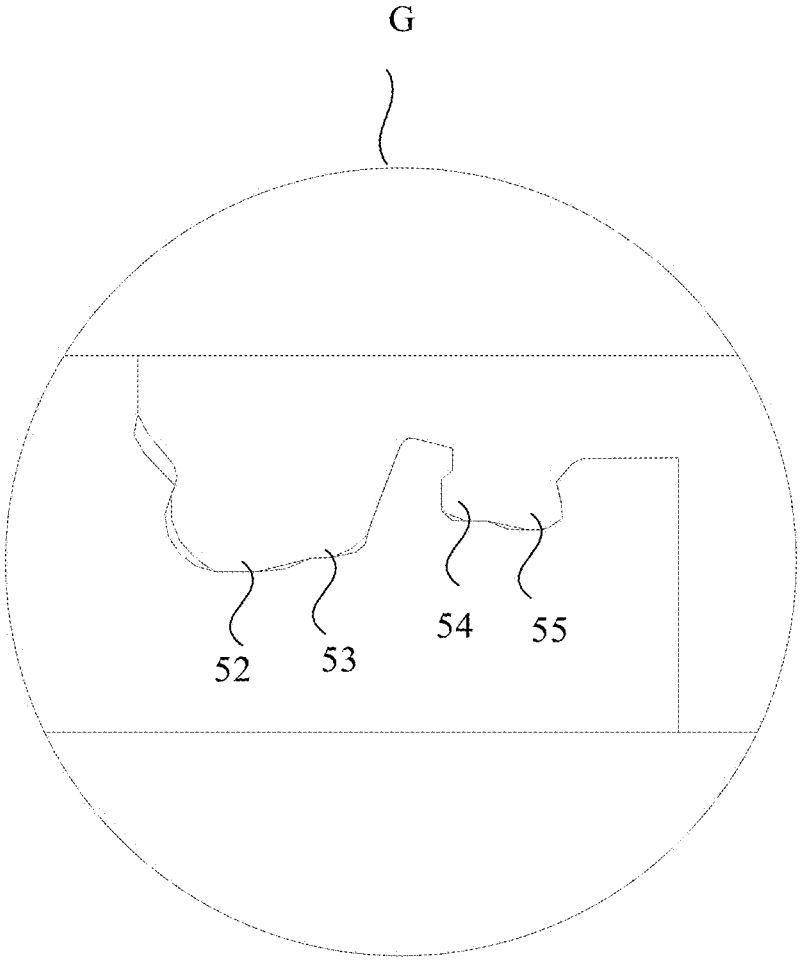
FIG. 15 is an enlarged view of portion "G" in FIG. 14.

Referring to FIGS. 13-15, differences from embodiment 2 are as follows. The second bottom portion 53 of the first bottom structure 8 is upwardly recessed. The area of the first base surface 16 corresponding to the second bottom portion 53 is convex upwardly. The fourth bottom portion 55 of the second bottom structure 25 is convex downwardly relative to the third bottom portion 54. The area of the fifth plane 38 of the second mortise 23 corresponding to the fourth bottom portion 55 is downwardly recessed.

In other embodiments, the second bottom portion 53 of the first bottom structure 8 is recessed upwardly. The area of the first base surface 16 corresponding to the second bottom portion 53 is convex upwardly. The fourth bottom portion 55 of the second bottom structure 25 is recessed upwardly with respect to the third bottom portion 54. The area of the fifth plane 38 of the second mortise 23 corresponding to the fourth bottom portion 55 is convex upwardly.

Embodiment 4

Figure 16:
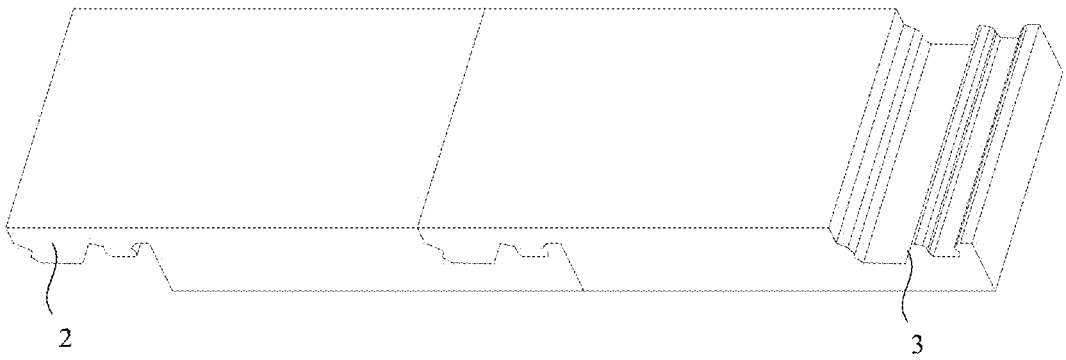
FIG. 16 schematically shows connection of two floorboards according to Embodiment 4 of the present disclosure.
Figure 17:
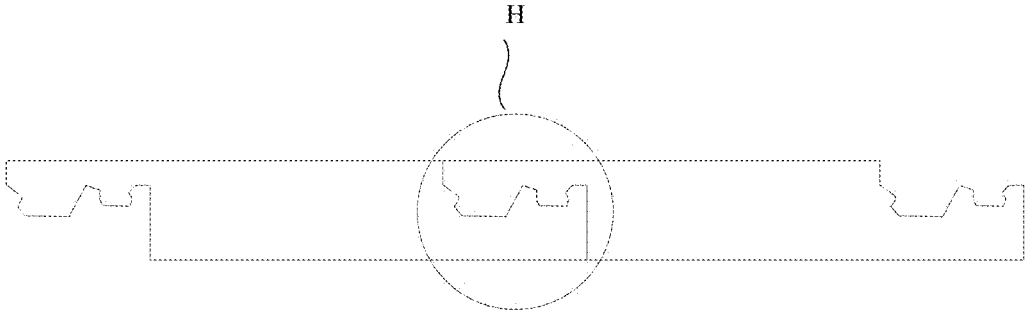
FIG. 17 is a front view of the two floorboards according to Embodiment 4 of the present disclosure in a connection state.
Figure 18:
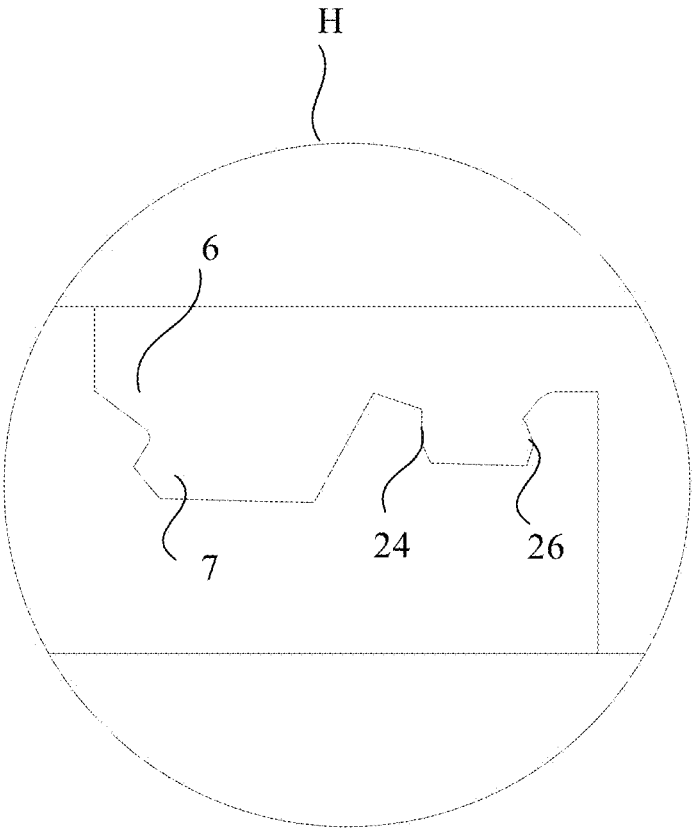
FIG. 18 is an enlarged view of portion "H" in FIG. 17.

Referring to FIGS. 16-18, differences from embodiment 1 are as follows. The first side portion 6 is completely embedded with the first recess 12. The second side portion 7 is completely embedded with the second recess 13. The first cavity 18 and the second cavity 19 are omitted. The second tenon 22 is embedded with the second mortise 23. The fourth side portion 24 and the fifth side portion 26 are curved. The fourth side portion 24 is recessed in a direction close to the first tenon 4, and the fifth side portion 26 is recessed in a direction away from the first tenon 4.

Described above are merely preferred embodiments of the disclosure, which are not intended to limit the disclosure. It should be understood that any modifications and replacements made by those skilled in the art without departing from the spirit of the disclosure should fall within the scope of the disclosure defined by the appended claims.

What is claimed is:

1. A floorboard, comprising:

a board body;

a first coupling structure; and a second coupling structure;

wherein the first coupling structure and the second coupling structure are provided on opposite sides of the board body, respectively; the first coupling structure comprises a first tenon; the second coupling structure is provided with a first mortise; and the first mortise is configured to accommodate at least a part of the first tenon for floorboard connection;

the first tenon comprises a first side portion and a second side portion; the first side portion is configured to at least partially slope downwardly towards the second coupling structure; the second side portion is configured to protrude in a direction away from the second coupling structure; the second side portion comprises a first connecting surface and a second connecting surface; the first connecting surface is configured to at least partially slope downwardly from a bottom end of the first side portion towards the direction away from the second coupling structure to form a cambered surface; the second connecting surface is configured to at least partially slope downwardly from a bottom end of the first connecting surface towards the second coupling structure to form a cambered surface; and the first connecting surface is connected to the second connecting surface;

the first mortise comprises a first recess and a second recess; the first recess is located above the second recess; the first recess and the second recess each extend in a direction towards the first coupling structure; the second recess comprises a third connecting surface and a fourth connecting surface; the third connecting surface is configured to at least partially slope downwardly from a bottom end of the first recess towards the first coupling structure; the fourth connecting surface is configured to at least partially slope downwardly from a bottom end of the third connecting surface towards a direction away from the first coupling structure; the first mortise further comprises a first base surface; and the first base surface is configured to extend from a bottom end of the fourth connecting surface; and in response to a case of connecting two floorboards, the first coupling structure of one of the two floorboards is matched with the second coupling structure of the other of the two floorboards, and the first connecting surface of one of the two floorboards is matched with the third connecting surface of the other of the two floorboards, so as to lock the two floorboards in a connection state;

the first tenon further comprises a first bottom structure and a third side portion; the first bottom structure is configured to extend from an end of the second connecting surface away from the first connecting surface towards the second coupling structure; and the third side portion is configured to at least partially slope downwardly towards the direction away from the second coupling structure, and is connected to an end of the first bottom structure away from the second side portion;

the first mortise further comprises a second base surface; the second base surface is configured to at least partially slope downwardly towards the first coupling structure, and is connected to an end of the first base surface away from the fourth connecting surface; and in response to a case that two floorboards are connected, the first base surface of one of the two floorboards abuts against the first bottom structure of the other of the two floorboards, and the second base surface of one of the two floorboards abuts against the third side portion of the other of the two floorboards; and the first bottom structure comprises a first bottom portion and a second bottom portion; an end of the first bottom portion is connected to the end of the second connecting surface away from the first connecting surface; and the first bottom portion is provided horizontally; and the second bottom portion is convex downwardly relative to the first bottom portion; the first base surface is matched with the first bottom structure; and an area of the first base surface corresponding to the second bottom portion is downwardly recessed to fit the second bottom portion; or the second bottom portion is upwardly recessed relative to the first bottom portion and the area of the first base surface corresponding to the second bottom portion is convex upwardly to fit the second bottom portion.

2. The floorboard of claim 1, wherein the first coupling structure further comprises a second tenon; the second coupling structure is further provided with a second mortise; the second tenon is provided on an inner side of the first tenon; the second mortise is provided on an outer side of the first mortise; and the second mortise is configured to accommodate at least a part of the second tenon.

3. The floorboard of claim 2, wherein the second tenon comprises a fourth side portion, a second bottom structure and a fifth side portion; the fourth side portion is configured to at least partially extend downwardly, and is connected with a first end of the second bottom structure; the second bottom structure is configured to extend from a bottom end of the fourth side portion towards a direction away from the first tenon; and the fifth side portion is configured to at least partially extend downwardly, and is connected with a second end of the second bottom structure.

4. The floorboard of claim 3, wherein the fourth side portion comprises a first straight section, a first inclined section, a second straight section and a second inclined section; the first straight section is configured to extend downwardly; the first inclined section is configured to at least partially slope downwardly from an end of the first straight section towards the first tenon; the second straight section is configured to extend downwardly from an end of the first inclined section away from the first straight section; and the second inclined section is configured to at least partially slope downwardly from an end of the second straight section away from the first inclined section towards a direction away from the first tenon, and is connected to the first end of the second bottom structure.

5. The floorboard of claim 4, wherein the fifth side portion comprises a third inclined section, a fourth inclined section and a fifth inclined section connected in sequence; the third inclined section is configured to at least partially slope downwardly towards the first tenon, and is connected to the second end of the second bottom structure; the fourth inclined section is configured to at least partially slope downwardly towards the direction away from the first tenon, and is connected to an end of the third inclined section away from the second bottom structure; and the fifth inclined section is configured to at least partially slope downwardly towards the first tenon, and is connected to an end of the fourth inclined section away from the third inclined section.

6. The floorboard of claim 5, wherein the second mortise comprises a first plane, a second plane, a third plane, a fourth plane, a fifth plane, a sixth plane, a seventh plane and an eighth plane connected in sequence;

the first plane is configured to extend downwardly; the second plane is configured to at least partially slope downwardly from an end of the first plane towards the first mortise; the third plane is configured to extend downwardly from an end of the second plane away from the first plane; the fourth plane is configured to at least partially slope downwardly from an end of the third plane away from the second plane towards a direction away from the first mortise; the fifth plane is configured to extend from an end of the fourth plane away from the third plane towards the direction away from the first mortise; the sixth plane is configured to slope downwardly towards the first mortise, and is connected to an end of the fifth plane away from the fourth plane; the seventh plane is configured to at least partially slope downwardly towards the direction away from the first mortise, and is connected to an end of the sixth plane away from the fifth plane; and the eighth plane is configured to at least partially slope downwardly towards the first mortise, and is connected to an end of the seventh plane away from the sixth plane; and in response to a case that two floorboards are connected, the first plane of one of the two floorboards abuts against the first straight section of the other of the two floorboards, the second plane of one of the two floorboards abuts against the first inclined section of the other of the two floorboards, the third plane of one of the two floorboards abuts against the second straight section of the other of the two floorboards, the fourth plane of one of the two floorboards abuts against the second inclined section of the other of the two floorboards, the fifth plane of one of the two floorboards abuts against the second bottom structure of the other of the two floorboards, the sixth plane of one of the two floorboards abuts against the third inclined section of the other of the two floorboards, the seventh plane of one of the two floorboards abuts against the fourth inclined section of the other of the two floorboards, and the eighth plane of one of the two floorboards abuts against the fifth inclined section of the other of the two floorboards.

7. The floorboard of claim 6, wherein the second bottom structure comprises a first bottom portion and a second bottom portion; a first end of the first bottom portion is connected to an end of the second inclined section away from the second straight section, and a second end of the first bottom portion is connected to a first end of the second bottom portion; a second end of the second bottom portion is connected to an end of the third inclined section away from the fourth inclined section; and the first bottom portion is provided horizontally; and the second bottom portion is recessed upwardly relative to the first bottom portion; the fifth plane is matched with the second bottom structure; and an area of the fifth plane corresponding to the second bottom portion is convex upwardly to fit the second bottom portion; or the second bottom portion is convex downwardly relative to the first bottom portion; and the area of the fifth plane corresponding to the second bottom portion is recessed downwardly to fit the second bottom portion.

8. The floorboard of claim 6, wherein a third mortise is provided between the first tenon and the second tenon; a third tenon is provided between the first mortise and the second mortise; and the third tenon is configured to fit the third mortise; and a sixth inclined section is provided between the third side portion and the fourth side portion; the sixth inclined section is configured to at least partially slope downwardly from an end of the third side portion away from the first bottom structure towards the direction away from the first tenon, and is connected to an end of the fourth side portion away from the second bottom structure; and the third side portion, the sixth inclined section and the fourth side portion are configured to together enclose the third mortise.

9. The floorboard of claim 8, wherein the second coupling structure further comprises a ninth plane; the ninth plane is configured to slope downwardly from an end of the second base surface away from the first base surface towards the direction away from the first mortise, and is connected to an end of the first plane away from the second plane;

the second base surface, the ninth plane, the first plane, the second plane, the third plane and the fourth plane are configured to together enclose the third tenon; and in response to a case that two floorboards are connected, the second base surface of one of the two floorboards abuts against the third side portion of the other of the two floorboards, the ninth plane of one of the two floorboards abuts against the sixth inclined section of the other of the two floorboards, the first plane of one of the two floorboards abuts against the first straight section of the other of the two floorboards, the second plane of one of the two floorboards abuts against the first inclined section of the other of the two floorboards, the third plane of one of the two floorboards abuts against the second straight section of the other of the two floorboards, and the fourth plane of one of the two floorboards abuts against the second inclined section of the other of the two floorboards.

* * * * *